US010280812B1

(12) United States Patent
Kim et al.

(10) Patent No.: US 10,280,812 B1
(45) Date of Patent: May 7, 2019

(54) CYLINDER HEAD AND CAMSHAFT CONFIGURATIONS FOR MARINE ENGINES

(71) Applicant: Brunswick Corporation, Lake Forest, IL (US)

(72) Inventors: Bo K. Kim, Fond du Lac, WI (US); Philip R. Walker, Oshkosh, WI (US); Travis R. Schmeling, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 65 days.

(21) Appl. No.: 15/492,687

(22) Filed: Apr. 20, 2017

(51) Int. Cl.

| | |
|---|---|
| ***F01L 1/04*** | (2006.01) |
| ***F01L 1/047*** | (2006.01) |
| ***F01L 1/14*** | (2006.01) |
| *F02B 61/04* | (2006.01) |

(52) U.S. Cl.
CPC ..... *F01L 1/047* (2013.01); *F01L 1/14* (2013.01); *F02B 61/045* (2013.01)

(58) Field of Classification Search
CPC ..... F01L 1/04; F01L 1/047; F02B 61/045
USPC ..... 123/90.16, 90.6, 90.48
See application file for complete search history.

(56) References Cited

U.S. PATENT DOCUMENTS

| | | | | |
|---|---|---|---|---|
| 3,958,900 | A * | 5/1976 | Ueno | F01L 13/06 417/237 |
| 4,932,367 | A | 6/1990 | Newman et al. | |
| 5,143,034 | A | 9/1992 | Hirose | |
| 5,887,557 | A * | 3/1999 | Battlogg | F01L 1/047 123/90.17 |
| 5,937,812 | A | 8/1999 | Reedy et al. | |
| 6,338,324 | B1 | 1/2002 | Tanaka et al. | |
| 6,343,581 | B2 * | 2/2002 | Suzuki | F01L 1/34 123/90.15 |
| 6,920,856 | B2 | 7/2005 | Lee | |
| 7,322,327 | B1 | 1/2008 | Kim | |
| 7,383,799 | B1 | 6/2008 | Wynveen et al. | |
| 7,421,988 | B2 * | 9/2008 | Battlogg | F01L 1/30 123/90.16 |
| 7,434,572 | B2 | 10/2008 | Hutter et al. | |
| 7,673,604 | B2 | 3/2010 | Takane et al. | |
| 8,056,158 | B2 | 11/2011 | Henshaw et al. | |
| 8,166,939 | B2 | 5/2012 | Lopez-Crevillen et al. | |
| 9,228,455 | B1 | 1/2016 | Belter et al. | |

OTHER PUBLICATIONS

Unpublished U.S. Appl. No. 15/405,510, filed Jan. 13, 2017.
Unpublished U.S. Appl. No. 15/254,127, filed Sep. 1, 2016.

* cited by examiner

*Primary Examiner* — Ching Chang
(74) *Attorney, Agent, or Firm* — Andrus Intellectual Property Law, LLP

(57) ABSTRACT

A cylinder head for a marine engine has an axially elongated camshaft, cam lobes that are axially spaced apart from each other along the camshaft, and valves that control one of a flow of intake air for combustion in the marine engine or a flow of exhaust gas from the marine engine. The cam lobes actuate the valves upon rotation of the camshaft. Each cam lobe comprises first and second cam lobe sections that are axially spaced apart from each other along the camshaft.

11 Claims, 5 Drawing Sheets

CYLINDER HEAD AND CAMSHAFT CONFIGURATIONS FOR MARINE ENGINES

FIELD

The present disclosure relates to marine engines and particular to cylinder head and camshafts configurations for marine engines.

BACKGROUND

The following U.S. Patents are incorporated herein by reference in entirety.

U.S. Pat. No. 9,228,455 discloses a marine engine for an outboard motor that comprises a bank of piston-cylinders, an intake camshaft that operates intake valves for controlling inflow of air to the bank of piston-cylinders, an exhaust camshaft that operates exhaust valves for controlling outflow of exhaust gas from the bank of piston-cylinders, and a cam phaser disposed on one of the intake camshaft and exhaust camshaft. The cam phaser is connected to and adjusts a timing of operation of the other of the intake camshaft and exhaust camshaft with respect to the one of the intake camshaft and exhaust camshaft.

U.S. Pat. No. 8,056,158 discloses a valve actuating system that determines a shape of its jam nut surface as a function of a resultant force on a ball stud exerted by a rocker arm on the ball stud during operation of the valve train. The contact surface of the jam nut, which is pressed against an associated surface of the head of an engine, is a conical surface with an included angle that is generally twice the magnitude of an angle between a resultant force on the ball stud and a central axis of the ball stud and its associated jam nut.

U.S. Pat. No. 7,383,799 discloses a system for monitoring changes in the operation of a valve system of an engine. An accelerometer provides vibration-related signals that are obtained by a microprocessor or similarly configured device and compared to a reference or baseline magnitude. The obtaining step can comprise the steps of measuring, filtering, rectifying, and integrating individual data points obtained during specific windows of time determined as a function of the rotational position of the crankshaft of the engine. These windows in time are preferably selected as a function of the position of exhaust or intake valves as they move in response to rotation of cams of the valve system.

U.S. Pat. No. 4,932,367 discloses a V-type four-stroke cycle internal combustion engine with an exhaust manifold and an air intake manifold disposed in the valley of the V-engine, and arranged one above the other. The exhaust from the cylinders passes through exhaust passages formed in the cylinder heads which discharge exhaust into the valley of the V-engine for collection in a central exhaust cavity provided in the exhaust manifold. A single exhaust discharge outlet is in communication with the central exhaust cavity for discharging exhaust therefrom. The air intake manifold includes a series of air intake passages that supply air to the cylinders from within the valley of the V-engine. A series of cylinder head intake passages are provided with openings facing the valley of the V-engine for receiving air there from.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter. In certain examples disclosed herein, a cylinder head for a marine engine has an axially elongated camshaft, cam lobes that are axially spaced apart from each other along the camshaft, and valves that control one of a flow of intake air for combustion in the marine engine or a flow of exhaust gas from the marine engine. The cam lobes actuate the valves upon rotation of the camshaft. Each cam lobe comprises first and second cam lobe sections that are axially spaced apart from each other along the camshaft.

DETAILED DESCRIPTION OF THE DRAWINGS

During research and development, the present inventors have determined that it is preferable to reduce weight in camshaft configurations for marine engines, thereby reducing weight of the marine engine. However any design that reduces weight preferably should also limit contact stress between the cam lobe and the valve bucket and also limit rocking motion of the bucket within the valve bore. This will guard against abnormal wear patterns on the end wall and bucket bore. The present inventors have also determined that maintaining proper lubrication between the cam lobes and valve buckets in a cylinder head is important to promote durability of the components. Without proper lubrication, scuffing and pitting can occur on both the lobes and the valve bucket. The present disclosure arose pursuant to the present inventors' recognitions of these challenges.

Figure 1:
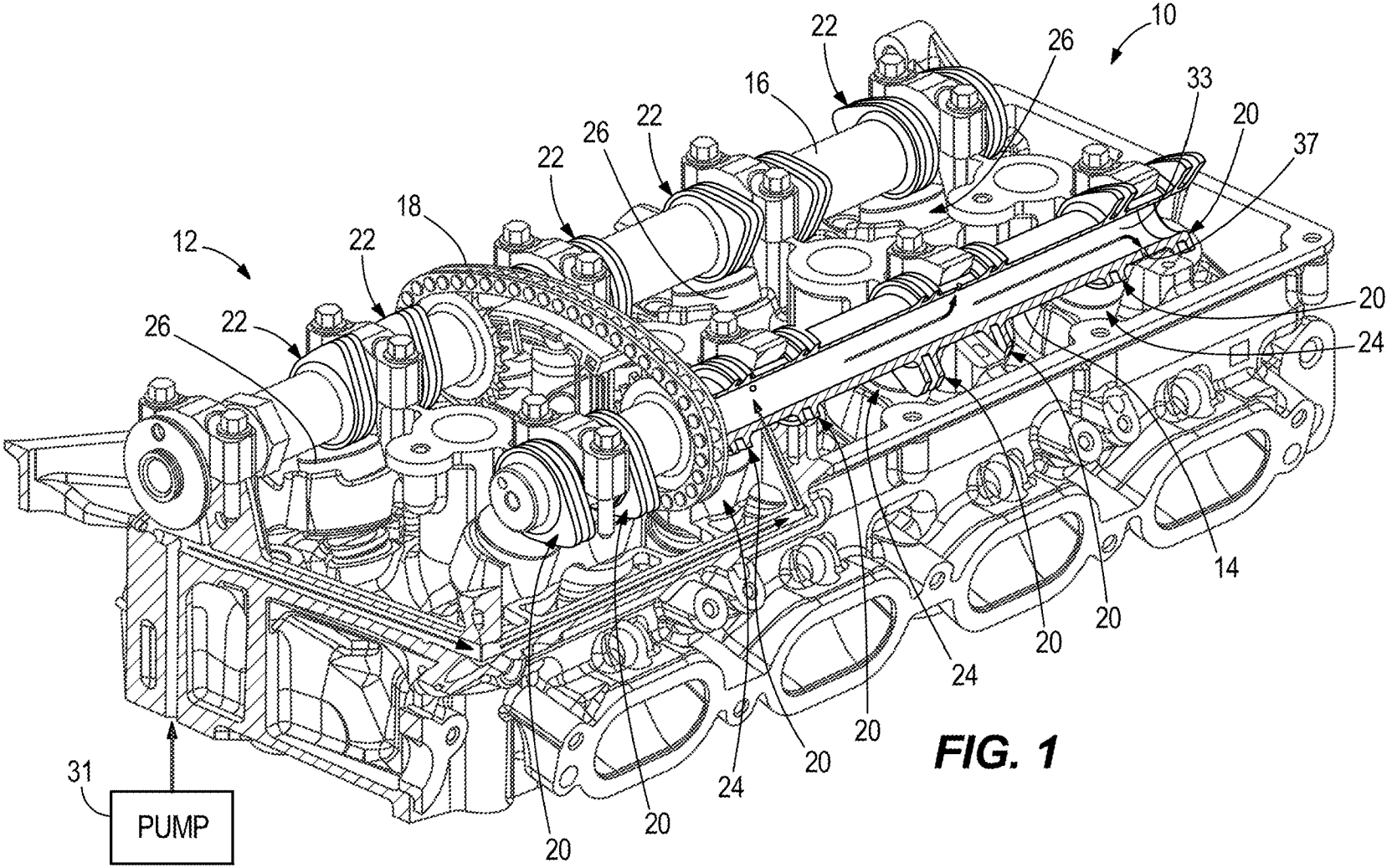
FIG. 1 is a perspective view of a cylinder head for a marine engine, having a portion of an intake camshaft shown in section view.
Figure 2:
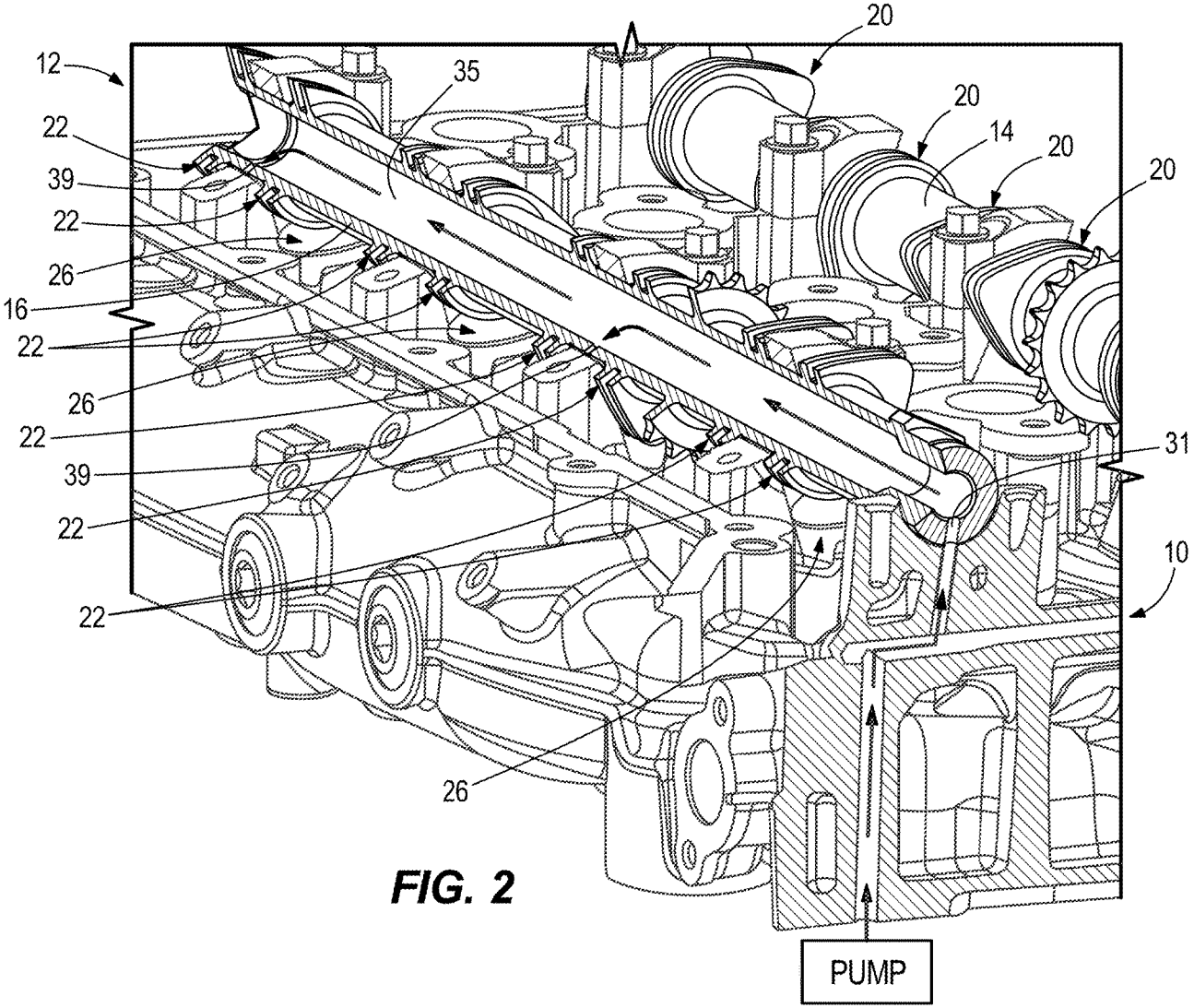
FIG. 2 is a perspective view of the cylinder head shown in FIG. 1, having a portion of an exhaust camshaft shown in section view.

FIGS. 1 and 2 depict a cylinder head 10 for an internal combustion engine for an outboard motor, for example the internal combustion engine disclosed in the above-incorporated U.S. Pat. No. 9,228,455. A dual overhead cam arrangement 12 facilitates flow of intake air into in the internal combustion engine and flow of exhaust gas from the internal combustion engine. The dual overhead cam arrangement 12 includes an intake camshaft 14 and an exhaust camshaft 16. The intake camshaft 14 and exhaust camshaft 16 extend parallel to each other and are connected together by a chain 18 or any other suitable connector, phaser, etc., such that rotation of one of the intake camshaft 14 and exhaust camshaft 16 causes commensurate or phased rotation of the other of the intake camshaft 14 and exhaust camshaft 16. The illustrated example is configured similar to the examples shown in U.S. Pat. No. 9,228,455, where the exhaust camshaft 16 is connected to a driveshaft of the internal combustion engine. In this example, operation of the internal combustion engine causes rotation of the driveshaft, which in turn causes rotation of the exhaust camshaft 16 and thus the intake camshaft 14, all as is conventional. Although shown in a horizontal orientation, the cylinder head 10 typically is vertically oriented in an outboard marine engine, such that the intake and exhaust camshafts 14, 16 extend vertically, for example as shown in FIG. 4.

The intake and exhaust camshafts 14, 16 each have cam lobes 20, 22, respectively, which operate intake and exhaust valves 24, 26 on the cylinder head 10 upon rotation of the intake and exhaust camshafts 14, 16. An intake and exhaust valve 24, 26 is provided for each cylinder in the internal combustion engine, as is conventional. The number of cylinders in the internal combustion engine can vary (e.g., 4-, 6-, 8-cylinder arrangements) and thus the number of intake and exhaust valves 24, 26 can also vary from what is shown. Rotation of the exhaust camshaft 16 causes rotation of the cam lobes 22, which cams open the exhaust valves 26. Rotation of the exhaust camshaft 16 causes rotation of the intake camshaft 14, which in turn causes rotation of the cam lobes 20, which cams open the intake valves 24. Continued rotation of the intake and exhaust camshafts 14, 16, further rotates the respective cam lobes 20, 22 out of camming engagement with the intake and exhaust camshafts 14, 16, which allows springs 29 (see e.g. FIG. 4) in each intake and exhaust valve 24, 26 to close the intake and exhaust valves 24, 26, all as is known and described, for example, in the above-incorporated U.S. Pat. No. 7,383,799. The above-described opening/closing cycle rapidly repeats during operation of the internal combustion engine to allow intake air into the internal combustion engine via the intake valves 24 and to emit exhaust gas from the internal combustion engine via the exhaust valves 26, as is conventional.

FIGS. 1 and 2 also include arrows that depict flow of lubricant (e.g., oil) from a pump 31 vertically upwardly through the center bores 33, 35 of the respective intake and exhaust camshafts 14, 16, and then radially out of respective radial holes 37, 39 in the intake and exhaust camshafts 14, 16, for drainage by gravity and thus lubricating the intake and exhaust valves 24, 26. The pump 31 can be any type of pump that is suitable for pumping lubricant, such as for example an electric pump that is powered by a battery or a mechanical pump that is driven by the internal combustion engine, e.g., rotation of the noted driveshaft. The pump 31 pumps the lubricant into the illustrated passages in the cylinder head 10 and then into radial inlet holes (e.g., 31 in FIG. 2) in each of the intake and exhaust camshafts 14, 16, which lead to the center bores 33, 35. Lubricant emitted from the radial holes 37, 39 drains by gravity onto the intake and exhaust valves 24, 26, thus lubricating the intake and exhaust valves 24, 26 and the interface between the cam lobes 20, 22 and intake and exhaust valves 24, 26, as further described herein below. Passage of lubricant through a camshaft and to intake and exhaust valves is known in the art and for example is described in pending U.S. patent application Ser. No. 15/405,510, filed Jan. 13, 2017.

Figure 3:
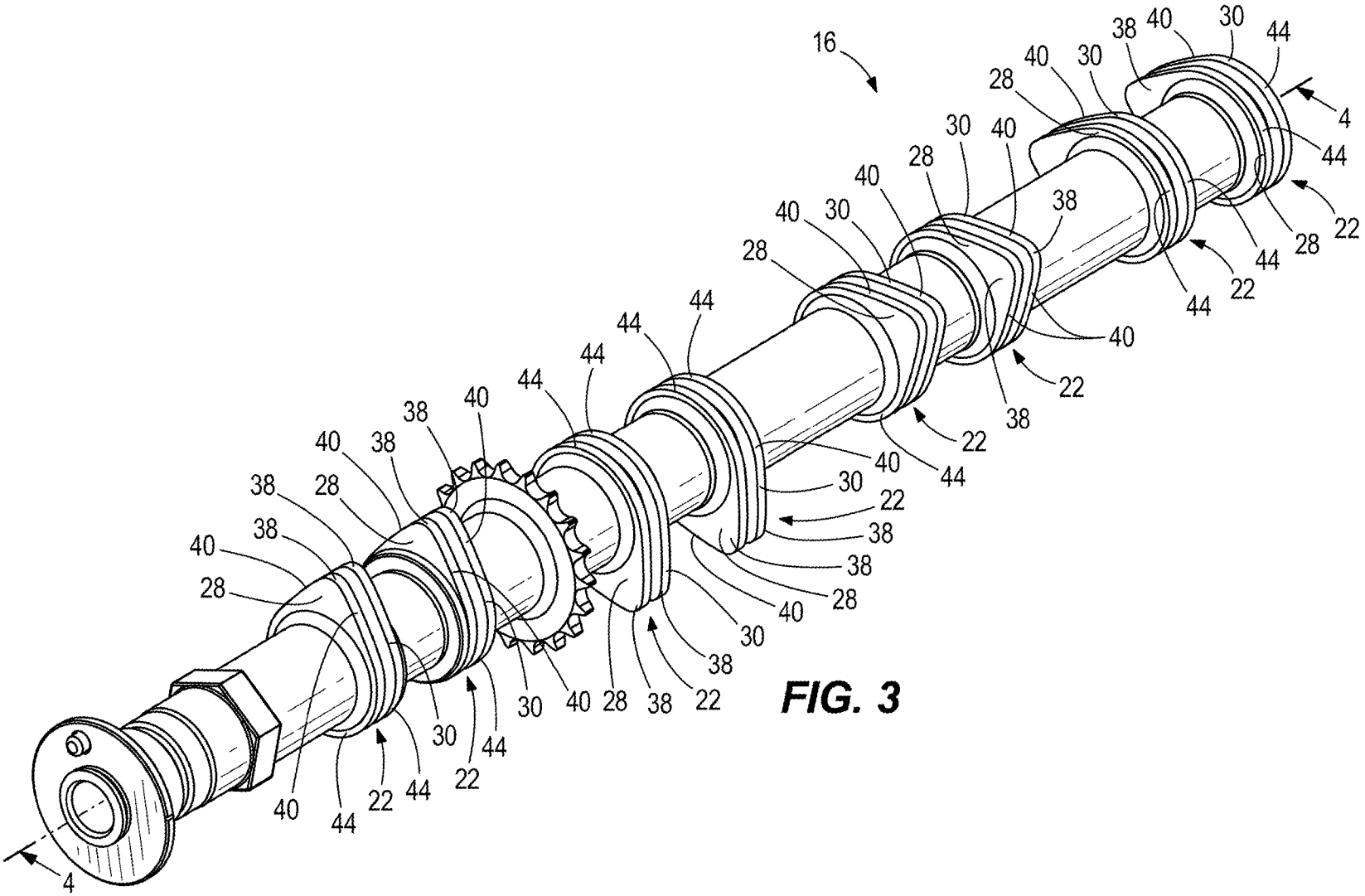
FIG. 3 is a perspective view of the exhaust camshaft shown in FIGS. 1 and 2.
Figure 4:
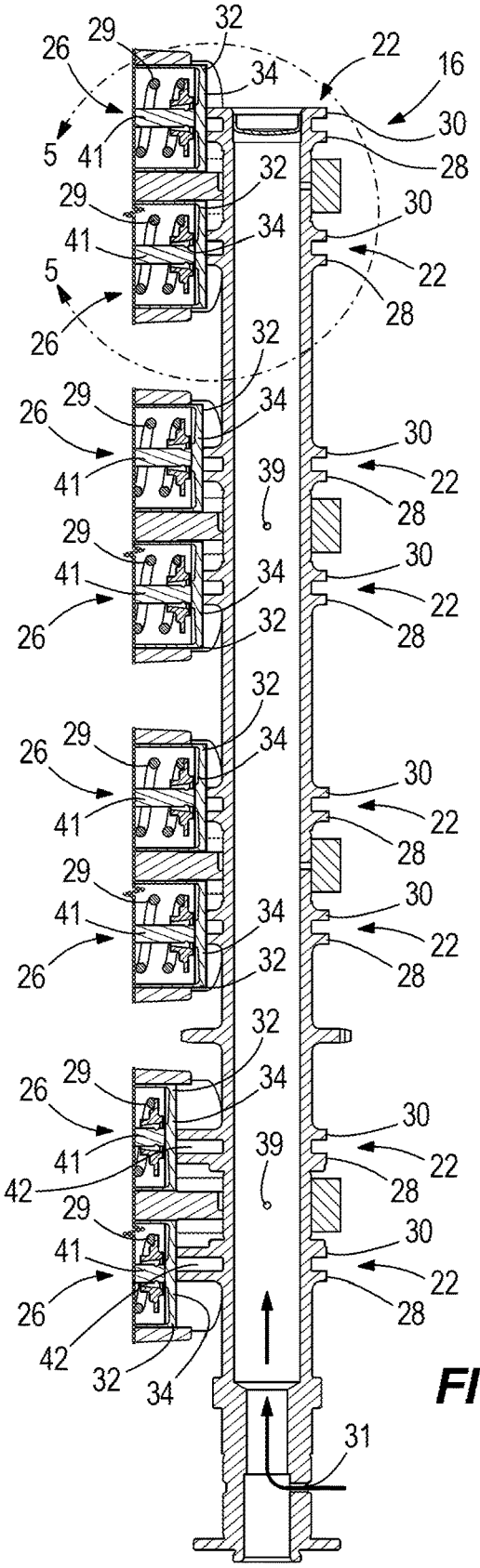
FIG. 4 is a view of Section 4-4 in FIG. 3, including the exhaust valves shown in FIG. 2.
Figure 5:
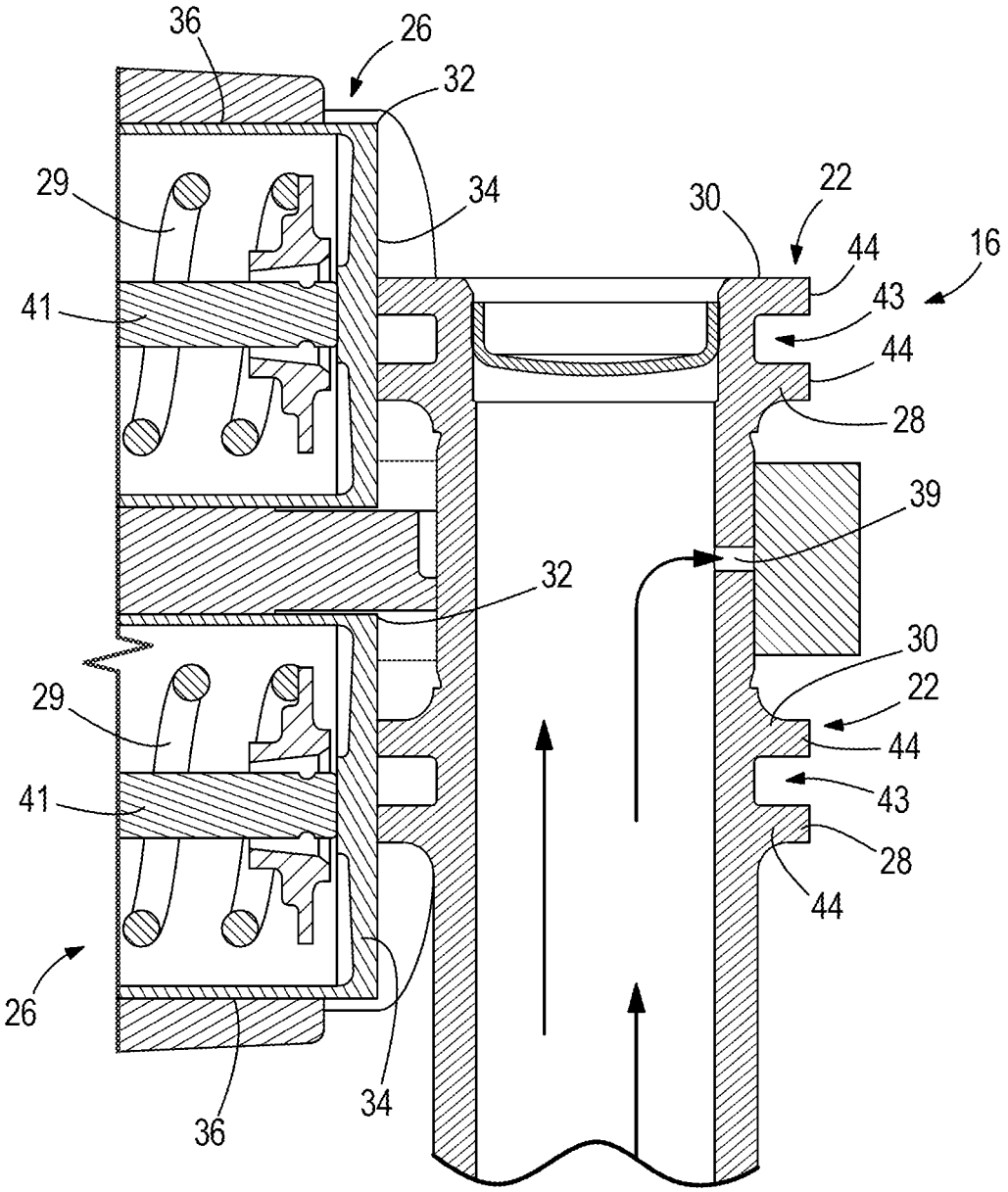
FIG. 5 is a view of section 5-5, taken in FIG. 5.

FIGS. 3-5 depict the exhaust camshaft 16 according to the present disclosure. It should be noted that the following description of the exhaust camshaft 16 and exhaust valves 24 equally applies to the intake camshaft 14 and intake valves 24. That is, the intake and exhaust camshafts 14, 16 are constructed similarly according to the inventive concepts of the present disclosure and thus for brevity are not separately described herein. Discussion of the exhaust manifold 14, cam lobes 22 and exhaust valves 26 herein below equally applies to the intake camshaft 16, cam lobes 20 and intake valves 24, etc.

According to the present disclosure, each cam lobe 22 is uniquely formed of first and second cam lobe sections 28, 30 that are axially spaced apart from each other along the axially elongated exhaust camshaft 16. As shown in FIGS. 4 and 5, the first and second cam lobe sections 28, 30 of each cam lobe 22 operate together to actuate (i.e. cam open) one of the respective exhaust valves 26.

The exhaust valves 26 are constructed similar to the exhaust valves disclosed in the incorporated U.S. Pat. No. 7,383,799. Each exhaust valves 26 has a spring-loaded valve bucket 32 having an end wall 34 that faces the cam lobe 22. Each valve bucket 32 further has a cylindrical sidewall 36 that extends from an outer perimeter of the end wall 34, away from the respective cam lobe 22, into a valve bore 35 on the cylinder head 10. The spring 29 is wrapped around a valve stem 41 and is contained within the cylindrical sidewall 36 and abuts the interior side of the end wall 34. The spring 29 biases the valve bucket 32 towards the cam lobe 22 such that the valve bucket 32 is spring-loaded into a closed position. Each cam lobe 22 is eccentrically shaped so that rotation of the exhaust camshaft 16 causes the cam lobe 22 to cam open the valve bucket 32 and valve stem 41, against the bias of the spring 29. Further rotation of the camshaft 16 causes the nose 38 of the cam lobe 22 to rotate past the end wall 34 of the valve bucket 32, thus allowing the spring 29 to bias the valve bucket 32 back towards the camshaft 16. Continuous rotation of the exhaust camshaft 16 thus causes reciprocation of the valve bucket 32 and valve stem 41 in the valve bore 35 as the cam lobe 22 cams open the valve bucket 32 and then the spring 29 closes the valve bucket 32. Further description of the respective intake and exhaust valves 24, 26 is conventional and thus not further described herein for brevity. The herein incorporated U.S. Pat. No. 7,383,799 provides further description of conventional intake and exhaust valve functionality and structure.

As shown in the figures, both of the first and second cam lobe sections 28, 30 engage the end wall 34 of the respective valve bucket 32 during rotation of the exhaust camshaft 16. Each of the first and second cam lobe sections 28 is eccentrically shaped. Both have a nose 38 with opposing flanks 40. Referring to FIG. 4, the noses 38 of the respective first and second cam lobe sections 28, 30 are axially spaced apart from each other so that an axial gap 42 exists there between. Both of the first and second cam lobe sections 28, 30 also have a base circle 44. Referring to FIG. 5, the base circles 44 of the first and second cam lobe sections 28, 30 are axially spaced apart from each other so that an axial gap 43 exists there between. Referring to FIG. 3, both of the first and second cam lobe sections 28, 30 has a tear-drop shape when viewed in profile. The first and second cam lobe sections 28, 30 are symmetrical with respect to each other. Each of the first and second cam lobe sections 28, 30 are also symmetrical with respect to a centerline that radially extends from the exhaust camshaft 16 through the profile.

Advantageously the present inventors have determined that providing the intake and exhaust camshafts 14, 16 with cam lobes 20, 22 having first and second cam lobe sections 28, 30 that are axially spaced apart from each other and configured to engage only one of the respective intake and exhaust valves 24, 26 reduces weight of the cam shaft configuration. The first and second cam lobe sections 28, 30 advantageously provide weight savings without promoting excessive rocking motion of the valve bucket 32, which otherwise would result with a similarly weighted single cam profile having a reduced width. The presently disclosed configurations can also enhance lubrication of the respective intake and exhaust valves 24, 26 in the cylinder head 10. Specifically the axial gaps 42, 43 advantageously provide an additional lubrication feed passage for improving lubrication to the interfaces between the cam lobes 20, 22 and intake and exhaust valves 24, 26. Better lubrication improves reliability and reduces friction, which improves performance of the internal combustion engine.

In the present description, certain terms have been used for brevity, clearness and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. A cylinder head for a marine engine comprising:

an axially elongated camshaft, a plurality of cam lobes that are axially spaced apart from each other along the axially elongated camshaft, and a plurality of valves that controls one of a flow of intake air for combustion in the marine engine or a flow of exhaust gas from the marine engine;

wherein the plurality of cam lobes actuates the plurality of valves upon rotation of the axially elongated camshaft, and wherein each cam lobe in the plurality of cam lobes comprises first and second cam lobe sections that are axially spaced apart from each other along the axially elongated camshaft;

wherein each cam lobe actuates only one valve in the plurality of valves;

wherein each valve in the plurality of valves comprises a valve bucket having an end wall; and wherein the first and second cam lobe sections simultaneously engage the end wall of the one valve bucket during rotation of the axially elongated camshaft.

2. The cylinder head according to claim 1, wherein each valve bucket comprises a cylindrical sidewall that extends from an outer perimeter of the end wall.

3. The cylinder head according to claim 1, wherein each valve bucket is spring-biased into a closed position and wherein each valve bucket is cammed open by the first and second cam lobe sections of one cam lobe in the plurality of cam lobes during rotation of the axially elongated camshaft.

4. The cylinder head according to claim 1, wherein the first and second cam lobe sections are spaced apart so that an axial gap exists there between.

5. The cylinder head according to claim 1, wherein each of the first and second cam lobe sections comprises a nose with opposing flanks, and wherein an axial gap exists between the noses of the first and second cam lobe sections.

6. The cylinder head according to claim 1, wherein each of the first and second cam lobe sections comprises a base circle and wherein an axial gap exists between the base circles of the first and second cam lobe sections.

7. The cylinder head according to claim 1, wherein each of the first and second cam lobe sections comprises a base circle and a nose with opposing flanks, and wherein an axial gap exists between the base circles of the first and second cam lobe sections and between the nose of the first and second cam lobe sections.

8. The cylinder head according to claim 1, wherein each of the first and second cam lobe sections are symmetrical.

9. The cylinder head according to claim 1, wherein the first and second cam lobe sections are symmetrical with respect to each other.

10. The cylinder head according to claim 1, wherein the axially elongated camshaft is an intake camshaft and wherein the plurality of valves is a plurality of intake valves for controlling the flow of intake air for combustion in the marine engine.

11. The cylinder head according to claim 10, wherein the axially elongated camshaft is an exhaust camshaft and wherein the plurality of valves is a plurality of exhaust valves for controlling the flow of exhaust gas from the marine engine.

* * * * *